US012735855B2

(12) United States Patent
Nishi et al.

(10) Patent No.: US 12,735,855 B2
(45) Date of Patent: Sep. 15, 2026

(54) ATTITUDE MAINTENANCE MECHANISM OF FRONT LOADER AND FRONT LOADER

(71) Applicant: KUBOTA CORPORATION, Osaka (JP)

(72) Inventors: Ryoichi Nishi, Sakai (JP); Shin Torii, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 177 days.

(21) Appl. No.: 18/711,702

(22) PCT Filed: Nov. 8, 2022

(86) PCT No.: PCT/JP2022/041545
§ 371 (c)(1),
(2) Date: May 20, 2024

(87) PCT Pub. No.: WO2023/139893
PCT Pub. Date: Jul. 27, 2023

(65) Prior Publication Data

US 2025/0012042 A1 Jan. 9, 2025

(30) Foreign Application Priority Data

Jan. 19, 2022 (JP) ..... 2022-006578

(51) Int. Cl.
*E02F 3/43* (2006.01)
*E02F 3/34* (2006.01)

(52) U.S. Cl.
CPC ..... *E02F 3/432* (2013.01); *E02F 3/3411* (2013.01)

(58) Field of Classification Search
None
See application file for complete search history.

(56) References Cited

U.S. PATENT DOCUMENTS 7,008,169 B1 * 3/2006 Miyanishi ..... E02F 3/38 414/722
7,442,001 B2 * 10/2008 Higashikawa ..... E02F 3/34 414/722
7,568,878 B2 * 8/2009 Frey ..... E02F 3/34 414/917
9,528,242 B2 * 12/2016 Oyama ..... E02F 3/433
9,637,888 B2 * 5/2017 Iwamoto ..... E02F 3/32
(Continued)

FOREIGN PATENT DOCUMENTS

EP 1 997 960 A2 12/2008
JP 11-241361 A 9/1999
(Continued)

OTHER PUBLICATIONS

International Search Report dated Jan. 31, 2023 in International Bureau of WIPO application PCT/JP2022/041545 with English language translation thereof.
(Continued)

*Primary Examiner* — Michael S Lowe
(74) *Attorney, Agent, or Firm* — GREENBLUM & BERNSTEIN, P.L.C.

(57) ABSTRACT

Provided is an attitude maintenance mechanism of a front loader capable of improving visibility. An attitude maintenance mechanism of a front loader that maintains an attitude of a bucket coupled to a boom by operating according to rocking of the boom including a pair of left and right boom frames includes a first link member rockable with respect to a side frame of the front loader and a second link member rockably provided with respect to the boom frames and coupled to the first link member and a bucket cylinder, and the first link member and the second link member are provided as a left and right pair with each of the boom frames interposed therebetween.

20 Claims, 13 Drawing Sheets

(56) References Cited

U.S. PATENT DOCUMENTS

| | | | | |
|---|---|---|---|---|
| 10,036,138 | B1 * | 7/2018 | Boyd | E02F 3/6273 |
| 10,361,138 | B2 | 7/2019 | Ledutke | |
| 2007/0020078 | A1 | 1/2007 | Frey | |
| 2015/0275471 | A1 | 10/2015 | Matsumoto et al. | |
| 2019/0194902 | A1 | 6/2019 | Boyd et al. | |
| 2019/0194906 | A1 | 6/2019 | Boyd | |
| 2019/0301128 | A1 | 10/2019 | Boyd | |
| 2020/0190767 | A1 | 6/2020 | Aoyama et al. | |
| 2020/0299922 | A1 | 9/2020 | Sato | |
| 2020/0340202 | A1 | 10/2020 | Boyd et al. | |
| 2020/0407944 | A1 | 12/2020 | Boyd et al. | |
| 2021/0293271 | A1 | 9/2021 | Iijima et al. | |
| 2021/0293276 | A1 | 9/2021 | Iijima et al. | |
| 2022/0018087 | A1 | 1/2022 | Iwamoto et al. | |
| 2022/0090355 | A1 | 3/2022 | Yasuda et al. | |

FOREIGN PATENT DOCUMENTS

| | | | |
|---|---|---|---|
| JP | 2006-336291 | A | 12/2006 |
| JP | 2011-17204 | A | 1/2011 |
| JP | 2015-190147 | A | 11/2015 |
| JP | 2016-84617 | A | 5/2016 |
| JP | 2019-060091 | A | 4/2019 |
| JP | 2019-116748 | A | 7/2019 |
| JP | 2019-116818 | A | 7/2019 |
| JP | 2020-023986 | A | 2/2020 |
| JP | 2020-023987 | A | 2/2020 |
| JP | 2020-153153 | A | 9/2020 |
| JP | 2021-8741 | A | 1/2021 |
| WO | 2009/073926 | A1 | 6/2009 |
| WO | 2020/202665 | A1 | 10/2020 |

OTHER PUBLICATIONS

Written Opinion dated Jan. 31, 2023 in International Bureau of WIPO application PCT/JP2022/041545 with English language translation thereof.

Extended European Search Report, dated Jan. 20, 2026, in European family member application No. 22922044.7.

Office Action issued in the corresponding Japanese Patent Appl. No. 2022006578 dated Mar. 30, 2026, translation.

* cited by examiner

ATTITUDE MAINTENANCE MECHANISM OF FRONT LOADER AND FRONT LOADER

TECHNICAL FIELD

The present invention relates to a technique of an attitude maintenance mechanism of a front loader and the front loader that maintains an attitude of a working tool coupled to a boom.

BACKGROUND ART

Conventionally, a technique of an attitude maintenance mechanism of a front loader that maintains an attitude of a working tool coupled to a boom is known. For example, Patent Literature 1 discloses such a technique.

An attitude maintenance mechanism described in Patent Literature 1 includes a link rod and a coupling body. The link rod is rockably supported by a sub frame (side frame), and is disposed above the boom at an interval. The coupling body is rockably supported by the boom. The coupling body is coupled to the link rod and a work-machine cylinder. The link rod and the coupling body are rocked according to the raising and lowering of the boom. Due to the rocking, an attitude of a bucket is maintained when the boom moves up and down.

However, in the attitude maintenance mechanism described in Patent Literature 1, the link rod or the like disposed above the boom may block a field of view of an operator, and visibility may be deteriorated.

CITATION LIST

Patent Literature

Patent Literature 1: JP H11-241361 A

SUMMARY OF INVENTION

Technical Problem

One aspect of the present disclosure has been made in view of the above circumstances, and an object to be solved by the present disclosure is to provide an attitude maintenance mechanism of a front loader and the front loader capable of improving visibility.

Solution to Problem

The problem to be solved by one aspect of the present disclosure is as described above, and means for solving the problem will be described below.

That is, according to one aspect of the present disclosure, there is provided an attitude maintenance mechanism of front loader that maintains an attitude of a working tool coupled to a boom by operating according to rocking of the boom including a pair of left and right boom frames, the attitude maintenance mechanism including: a first link member that is rockable with respect to a side frame of the front loader; and a second link member rockably provided with respect to the boom frames and coupled to the first link member and a bucket cylinder, in which the first link member and the second link member are provided as a left and right pair with each of the boom frames interposed between the first link member and the second link member.

According to one aspect of the present disclosure, it is possible to suppress the attitude maintenance mechanism from blocking a field of view of an operator and to improve the visibility.

In one aspect of the present disclosure, the first link member is disposed so as not to overlap with the boom frames in plan view.

According to one aspect of the present disclosure, since the first link member can be prevented from interfering with the boom frames, the degree of freedom in design can be improved.

In one aspect of the present disclosure, the first link member and the second link member are disposed such that at least a part of the first link member and the second link member overlap the boom in a side view regardless of a rock angle of the boom.

According to one aspect of the present disclosure, it is possible to effectively suppress the attitude maintenance mechanism from blocking the field of view of the operator and to effectively improve the visibility.

In one aspect of the present disclosure, a pair of the left and right first link members includes bent portions bent inward from each other.

According to one aspect of the present disclosure, the strength of the first link members can be improved by the bent portions.

In one aspect of the present disclosure, each of the bent portions is formed to extend from a rocking shaft of each of the first link members to a coupling portion between the first link member and the second link member.

According to one aspect of the present disclosure, the strength of the first link member can be effectively improved.

In one aspect of the present disclosure, the second link member includes: a first member; and a second member fixed to one of left and right sides of the first member.

According to one aspect of the present disclosure, one of the first member and the second member can be moved away from the boom frame to secure a gap with the boom frame.

In one aspect of the present disclosure, a rocking shaft of the first link member, a coupling portion between the first link member and the second link member, and a coupling portion between the second link member and the bucket cylinder are located on substantially the same straight line in a side view.

According to one aspect of the present disclosure, it is possible to effectively suppress the attitude maintenance mechanism from blocking the field of view of the operator and to effectively improve the visibility.

In one aspect of the present disclosure, a pair of the left and right first link members is formed to be bilaterally symmetrical with each other, and a pair of the left and right second link members is formed to be bilaterally symmetrical with each other.

According to one aspect of the present disclosure, a sense of unity can be provided to the pair of left and right first link members and the pair of left and right second link members, and aesthetic appearance can be improved.

In one aspect of the present disclosure, a front loader includes the above-described attitude maintenance mechanism.

According to one aspect of the present disclosure, a height position of the attitude maintenance mechanism can be lowered, and the visibility can be improved by suppressing the attitude maintenance mechanism from blocking the field of view of the operator.

In one aspect of the present disclosure, a rocking shaft of the second link member is provided so as to cross an internal space of the boom.

According to one aspect of the present disclosure, the rocking shaft of the second link member can be disposed at a relatively low position, and it is possible to suppress the second link member from blocking the field of view of the operator.

An aspect of the present disclosure includes: the boom; and a tube portion disposed inside the boom, in which the boom includes: a support portion that supports the rocking shaft of the second link member; and a guide portion at least a part of which is disposed inside the boom and that guides the tube portion so as to avoid the support portion.

According to one aspect of the present disclosure, the tube portion is easily disposed in the boom by guiding the tube portion by the guide portion.

Advantageous Effects of Invention

According to one aspect of the present disclosure, visibility can be improved.

BRIEF DESCRIPTION OF DRAWINGS

FIG. 7(*b*) is an enlarged plan sectional view illustrating a second link member.

DESCRIPTION OF EMBODIMENT

Hereinafter, the entire configuration of a tractor 1 including a front loader 10 according to one embodiment of the present invention will be described.

Figure 1:
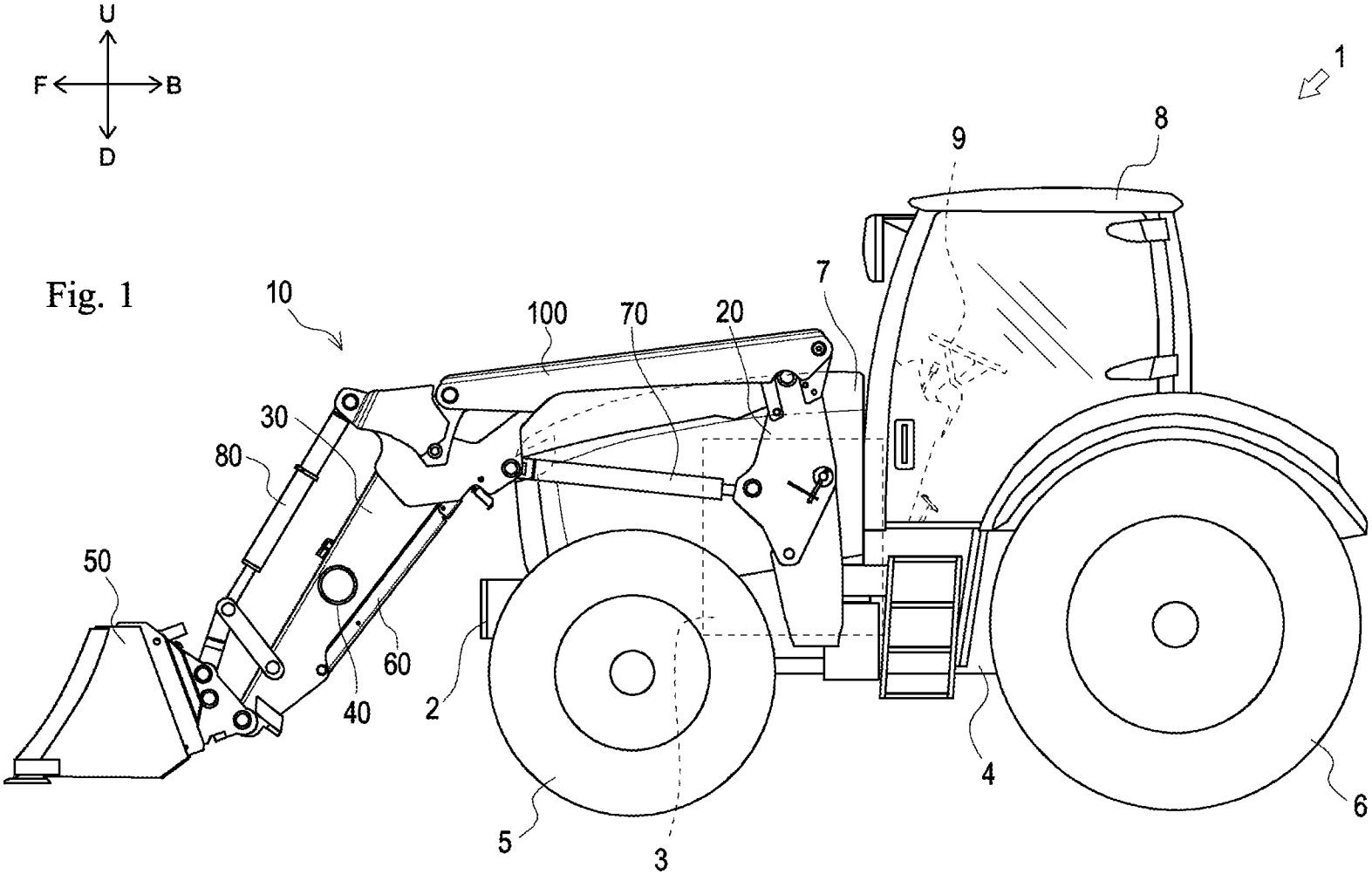
FIG. 1 is a side view illustrating an overall configuration of a tractor including a front loader according to an embodiment of the present invention.

As illustrated in FIG. 1, the tractor 1 mainly includes a machine body frame 2, an engine 3, a transmission case 4, front wheels 5, rear wheels 6, a bonnet 7, a cabin 8, a steering wheel 9, and a front loader 10.

The machine body frame 2 is a frame-shaped member formed by appropriately combining a plurality of panel members. The machine body frame 2 is formed in a substantially rectangular shape in plan view. The machine body frame 2 is disposed with its longitudinal direction oriented in a front-rear direction. The engine 3 is fixed to a rear portion of the machine body frame 2. The transmission case 4 is fixed to a rear portion of the engine 3. A front portion of the machine body frame 2 is supported by the pair of left and right front wheels 5 through a front axle mechanism (not illustrated). A rear portion of the transmission case 4 is supported by the pair of left and right rear wheels 6 through a rear axle mechanism (not illustrated). The engine 3 is covered with the bonnet 7.

Power of the engine 3 can be transmitted to the front wheels 5 through the front axle mechanism and can be transmitted to the rear wheels 6 through the rear axle mechanism after being shifted by a transmission device (not illustrated) stored in the transmission case 4. The front wheels 5 and the rear wheels 6 are rotationally driven by the power of the engine 3, and the tractor 1 can travel.

The cabin 8 is provided behind the engine 3. Inside the cabin 8, a living space on which an operator boards is formed. In the living space, the steering wheel 9 for adjusting a turning angle of the front wheels 5, various operation tools, a seat on which the operator sits, and the like are disposed.

The front loader 10 is mounted to a front portion of the tractor 1. Hereinafter, a detailed configuration of the front loader 10 will be described with reference to FIGS. 2 to 10.

The front loader 10 mainly includes a side frame 20, a boom 30, a coupling frame 40, a bucket 50, a stand 60, a boom cylinder 70, a bucket cylinder 80, a tube portion 90, an attitude maintenance mechanism 100, and the like.

Figure 4:
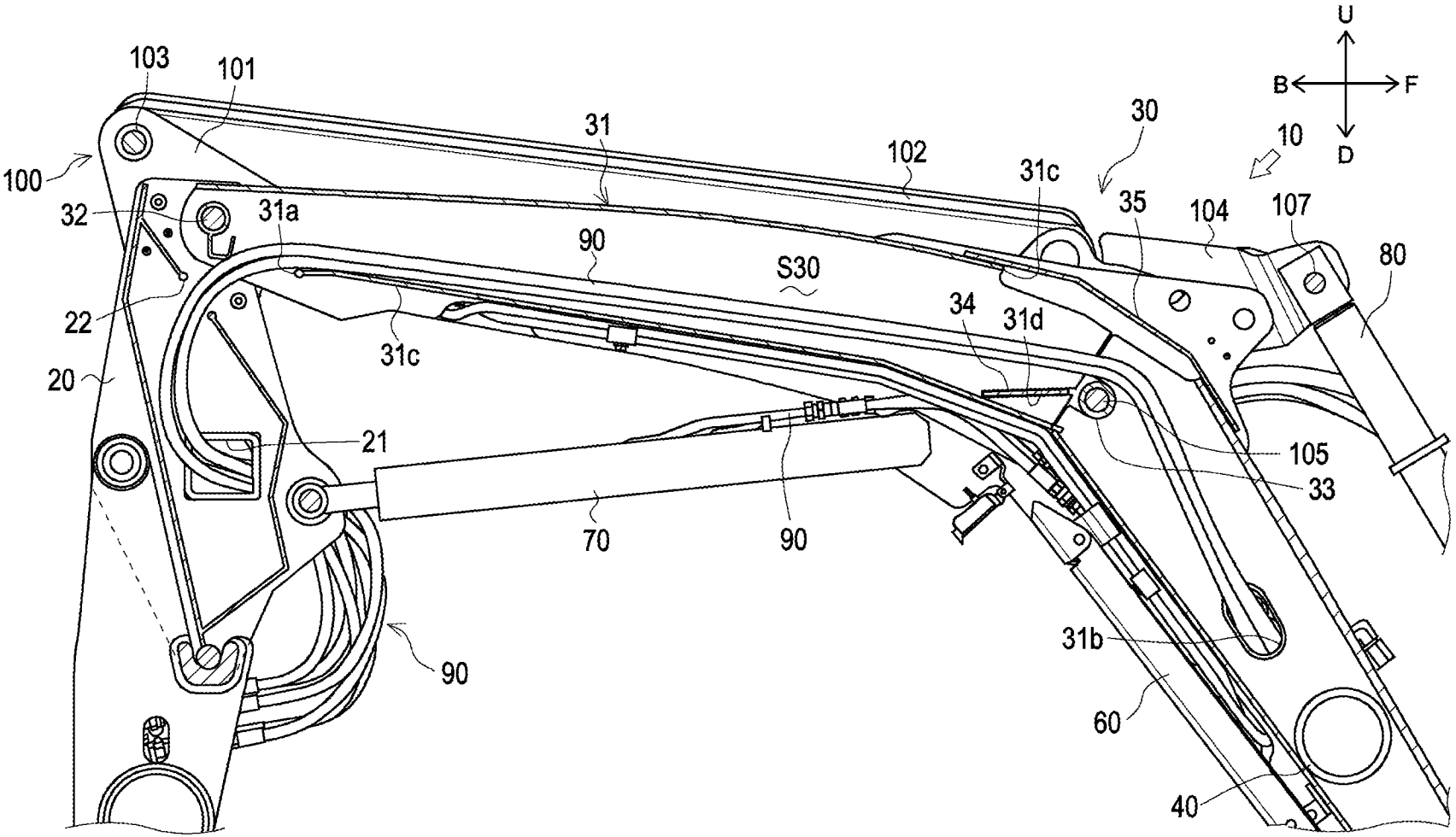
FIG. 4 is a right side cross-sectional view of the same.
Figure 5:
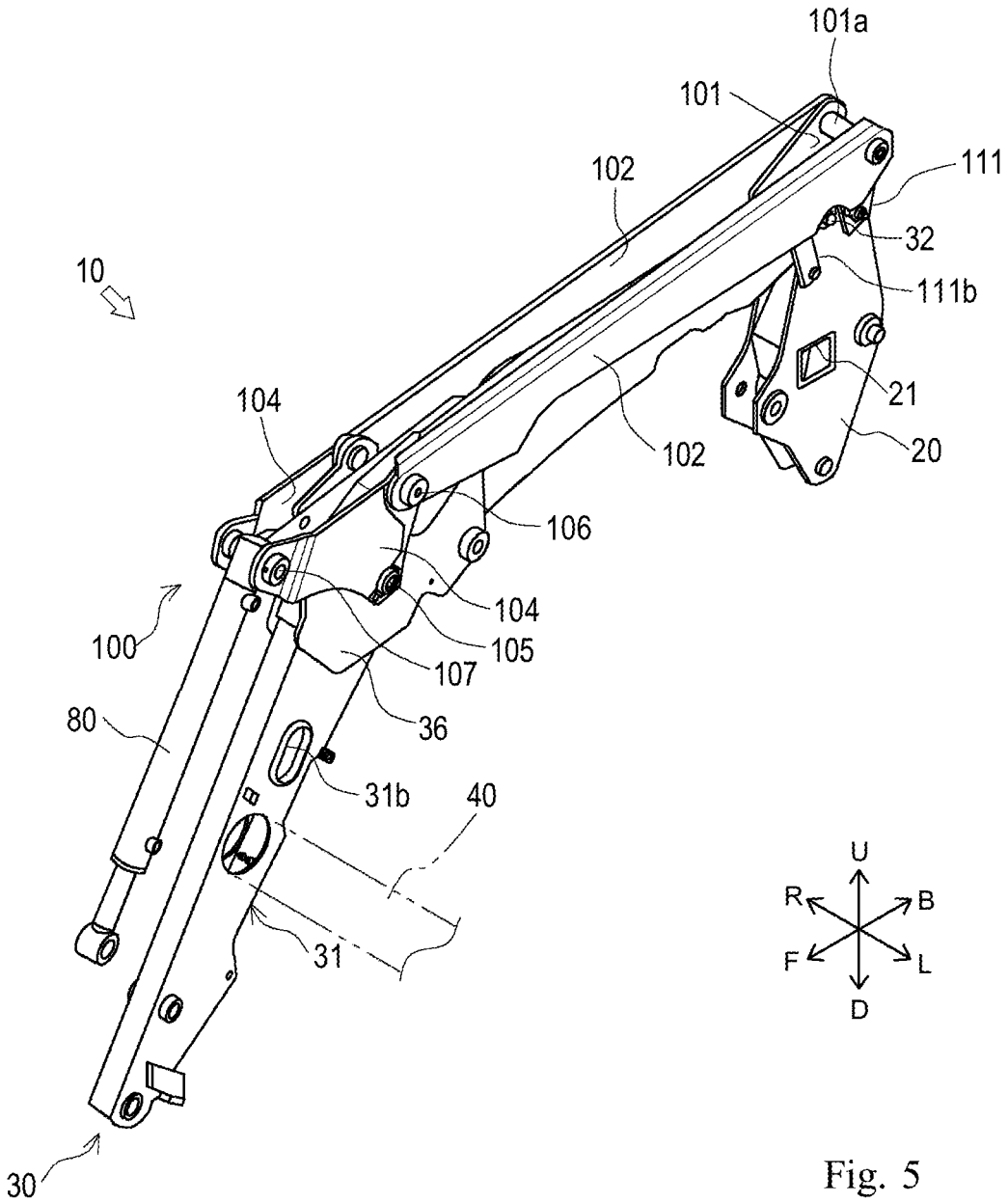
FIG. 5 is a perspective view illustrating a side frame, a boom, a boom cylinder, and an attitude maintenance mechanism.

The side frame 20 illustrated in FIGS. 2 and 3 rockably supports the boom 30 to be described later. The side frame 20 is formed in a hollow shape. The side frame 20 is detachably attached to a vehicle body (the machine body frame 2 and the transmission case 4) of the tractor 1. The side frames 20 are provided on the left and right of the vehicle body. As illustrated in FIGS. 4 and 5, the right side frame 20 includes a first opening 21 and a second opening 22.

The first opening 21 and the second opening 22 are portions through which the tube portion 90 described later can be inserted. The first opening 21 is formed on the left side surface of the side frame 20. The second opening 22 is formed on the upper surface of the side frame 20.

Figure 10:
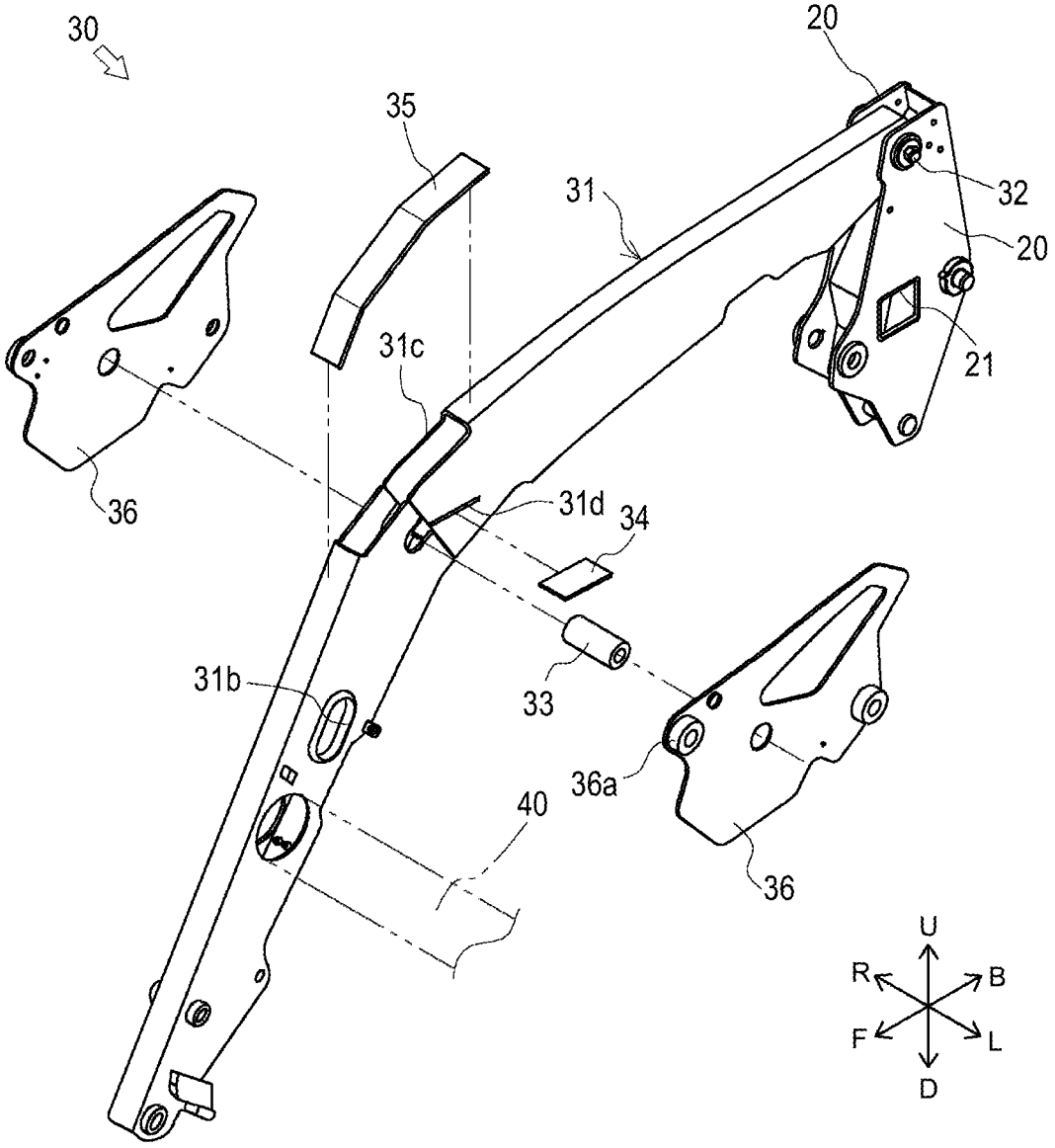
FIG. 10 is an exploded perspective view of the boom.

The booms 30 are rockably supported by the left and right side frames 20. The boom 30 is disposed so as to extend forward and downward from an upper portion of the side frame 20. As illustrated in FIGS. 4 and 10, the boom 30 includes a boom frame 31, a rocking shaft 32, a boss portion 33, a guide portion 34, a closing portion 35, and a side plate 36. The boom frame 31, the rocking shaft 32, the boss portion 33, the closing portion 35, and the side plate 36 are provided in pairs on the left and right. Furthermore, the guide portion 34 is provided on the right boom frame 31. Hereinafter, the configuration of the boom frame 31 and the like will be described by taking the right boom frame 31 and the like as an example.

The boom frame 31 forms a main structural body of the boom 30. The boom frame 31 is formed in a hollow shape. The right boom frame 31 includes a third opening 31*a*, a fourth opening 31*b*, a through hole 31*c*, and a slit 31*d*. Note that the left boom frame 31 is configured similarly to the right boom frame 31 except that the third opening 31*a* and the fourth opening 31*b* are not provided.

The third opening 31*a* and the fourth opening 31*b* are portions through which the tube portion 90 can be inserted. The third opening 31*a* is formed at a rear end of the boom frame 31. The fourth opening 31*b* is formed at a lower front portion of the boom frame 31. The through hole 31*c* is a hole that vertically penetrates the boom frame 31. The through-hole 31*c* is formed in a front-rear middle portion (in front of the third opening 31*a* and above the fourth opening 31*b*) of the upper surface of the boom frame 31. The slit 31*d* is a horizontally long hole penetrating the boom frame 31 in the left-right direction. The slit 31*d* is formed below the through hole 31*c*.

The rocking shaft 32 rockably supports the boom frame 31 with respect to the side frame 20. The rocking shaft 32 is formed in a cylindrical shape with its axis oriented to the left and right. In the present embodiment, a shaft-shaped member longer than left-right widths of the side frame 20 and the boom frame 31 is used as the rocking shaft 32. The rocking shaft 32 is inserted through the side frame 20 and the boom frame 31.

The boss portion 33 is for attaching a second link member 104 of the attitude maintenance mechanism 100 described later. The boss portion 33 is formed in a substantially cylindrical shape with an axis line facing the left and right. A length of the boss portion 33 in the axial direction is formed to be longer than a left-right width of the boom frame 31. The boss portion 33 is provided so as to penetrate both left and right side surfaces of the boom frame 31. In this way, the boss portion 33 is disposed so as to cross an internal space S30 of the boom 30. The boss portion 33 is fixed to both left and right side surfaces of the boom frame 31 by welding or the like.

The guide portion 34 is for guiding the tube portion 90 described later. The guide portion 34 is formed in a plate shape with a plate surface facing substantially the vertical direction. A left-right width of the guide portion 34 is formed to be substantially equal to the left-right width of the boom frame 31. The guide portion 34 is fixed to the slit 31*d* of the right boom frame 31 by welding or the like. In this manner, substantially the entire guide portion 34 is disposed inside the boom 30. Furthermore, the guide portion 34 is provided between the boss portion 33 and the bottom surface of the boom frame 31. More specifically, the guide portion 34 is formed to extend substantially in the front-rear direction in a side view from the vicinity of a top portion of the boss portion 33 to the bottom surface of the boom frame 31 so as to guide the tube portion 90 upward of the boss portion 33.

The closing portion 35 is a plate-shaped member that closes the through hole 31*c* of the boom frame 31. The closing portion 35 is fixed to the boom frame 31 after the boss portion 33 and the guide portion 34 are fixed to the boom frame 31. As a result, the boss portion 33 and the guide portion 34 can be easily welded into the boom frame 31 through the through hole 31*c*.

The side plate 36 is formed in a plate shape with a plate surface facing substantially the left-right direction. The side plates 36 are provided on the left and right of the boom frame 31. The side plate 36 includes a boss portion 36*a*.

The boss portion 36*a* illustrated in FIG. 10 is a portion connectable to the bucket cylinder 80 described later. The boss portion 36*a* is formed in a substantially cylindrical shape with an axis line facing the left and right. The boss portion 36*a* is formed so as to protrude to one of the left and right sides (left and right outer sides in a case where the boom frame 31 located between the side plates 36 is used as a reference) from the side surface of the side plate 36. The boss portion 36*a* is used in a case where the attitude maintenance mechanism 100 is not provided in the front loader 10. In this case, the boss portion 36*a* is coupled to the bucket cylinder 80 through a coupling shaft 81 (see FIG. 13).

Figure 2:
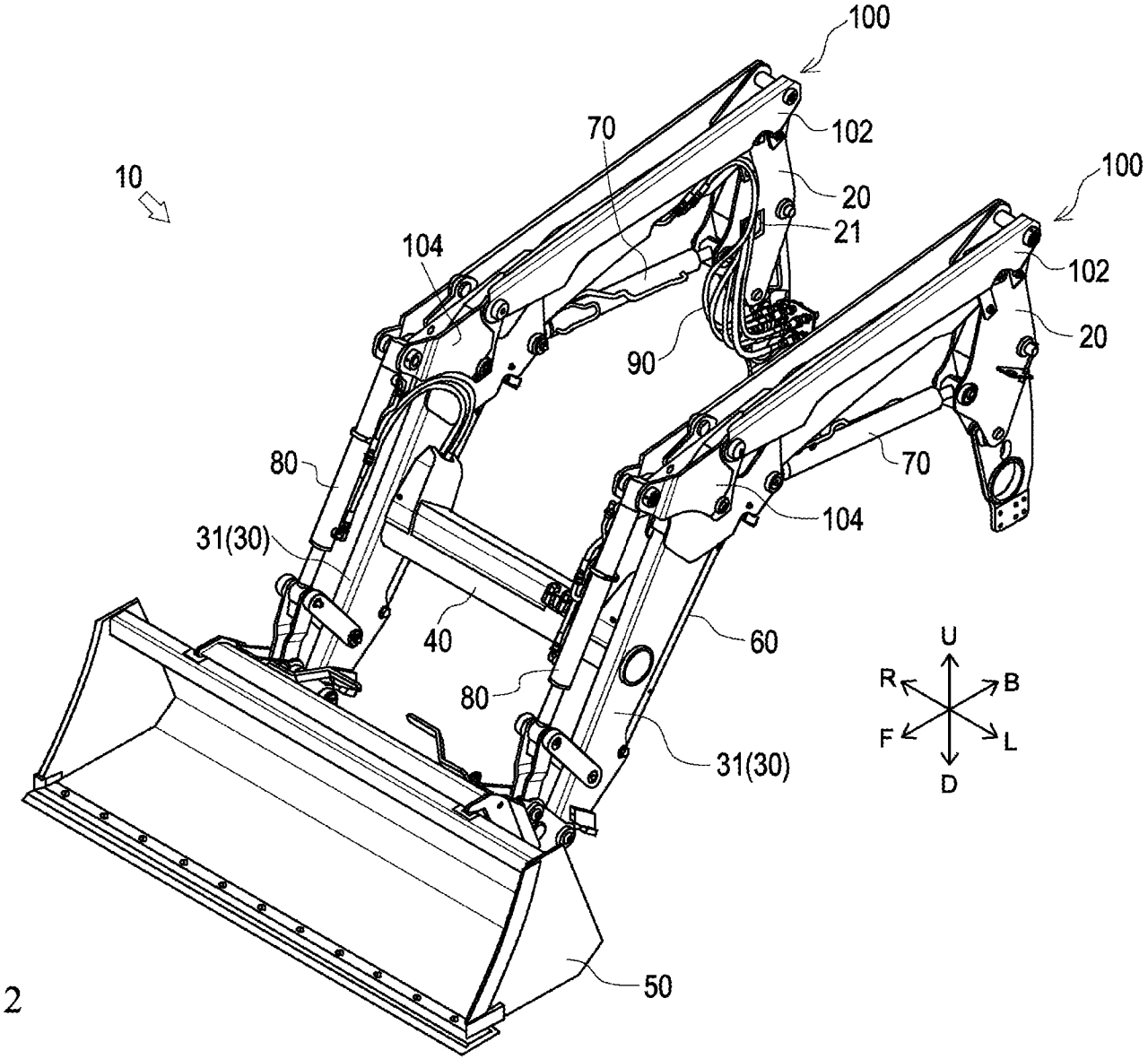
FIG. 2 is a perspective view illustrating the front loader.
Figure 3:
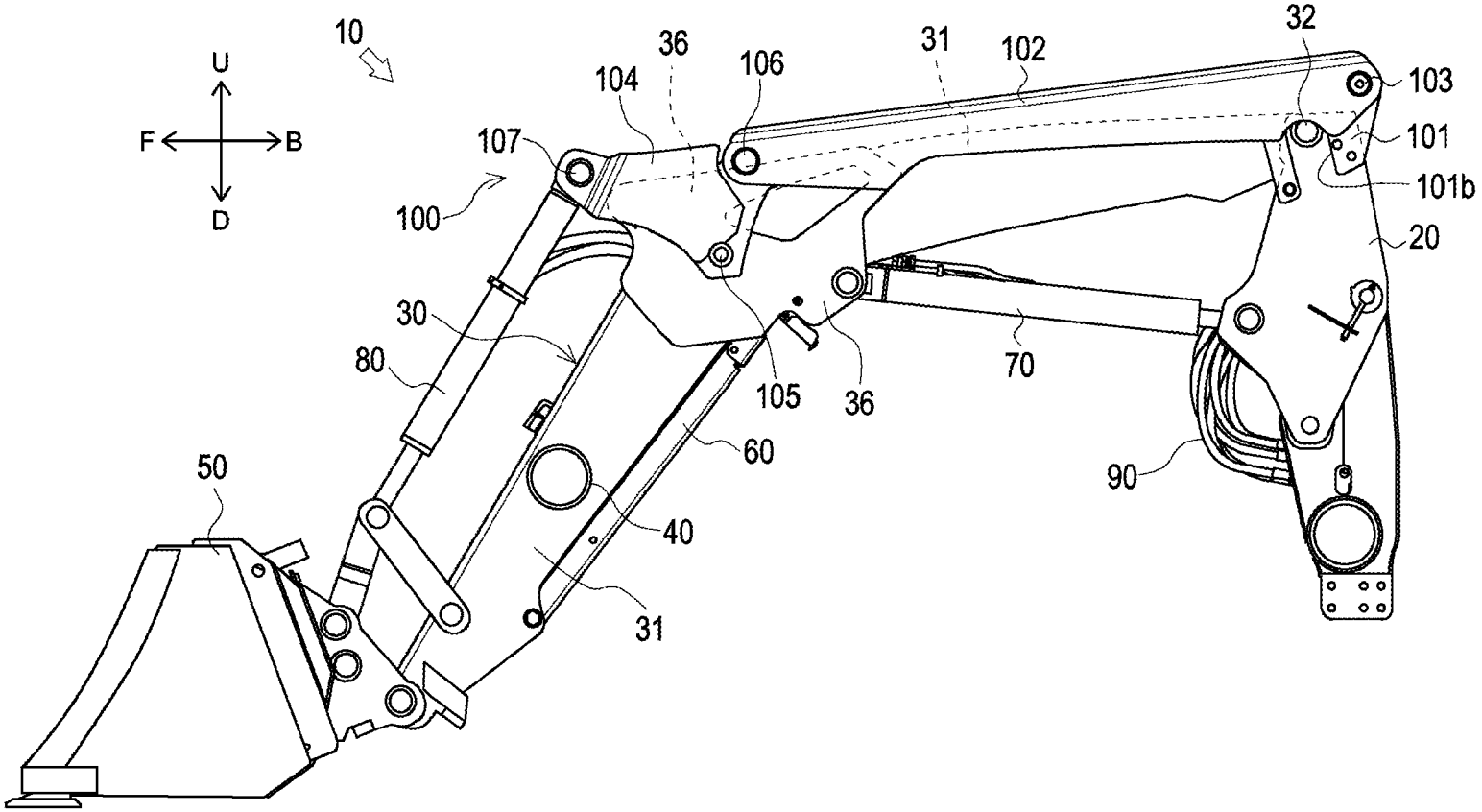
FIG. 3 is a left side view of the same.

The coupling frame 40 illustrated in FIGS. 2 and 3 couples the left and right booms 30. The coupling frame 40 is formed in a substantially cylindrical shape with its axis oriented to the left and right. The coupling frame 40 is provided across the left and right booms 30.

The bucket 50 is formed to open forward. The bucket 50 is rockably coupled to the front end of the boom 30.

The stand 60 allows the front loader 10 detached from the vehicle body of the tractor 1 to stand by itself. One stand 60 (a pair of right and left stands) is provided at each lower front portion of the right and left boom frames 31. The stand 60 can be switched between a storage position where the stand is stored in the boom 30 and a support position where the stand is grounded to support the weight of the front loader 10. Note that the stand 60 switched to the storage position is illustrated in the drawings.

The boom cylinder 70 rocks the boom 30 with respect to the side frame 20. The boom cylinder 70 is rockably coupled to the side frame 20 and the boom 30. A pair of the left and right boom cylinders 70 is provided.

The bucket cylinder 80 rocks the bucket 50 with respect to the boom 30. The bucket cylinder 80 is rockably coupled to the boom 30 and the bucket 50. The bucket cylinder 80 illustrated in FIGS. 2 and 3 is rockably coupled to the boom 30 through the second link member 104 of the attitude maintenance mechanism 100. A pair of the left and right bucket cylinders 80 is provided.

The tube portion 90 illustrated in FIGS. 2 and 4 is for forming a flow path of hydraulic oil. The tube portion 90 includes a first tube portion connecting a pump (not illustrated) of the tractor 1 and the boom cylinder 70, and a second tube portion connecting the pump and the bucket cylinder 80. The tube portion 90 is introduced into the side frame 20 from the first opening 21, and is introduced into the boom 30 from the side frame 20 through the second opening 22 and the third opening 31*a*. Furthermore, the tube portion 90 is led out from the inside of the boom 30 onto the coupling frame 40 through the fourth opening 31*b*, and is connected to the boom cylinder 70 and the bucket cylinder 80.

Figure 6:
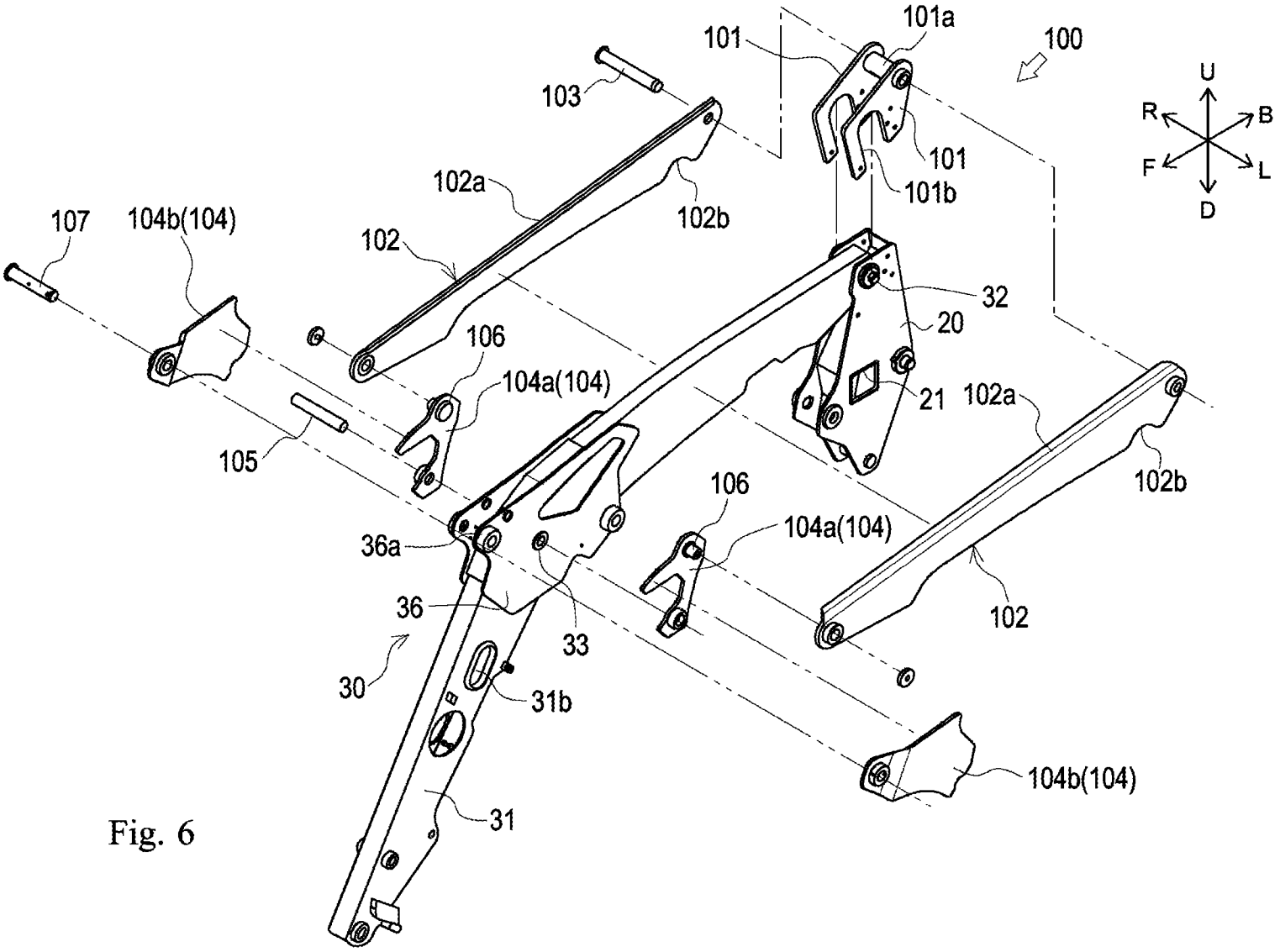
FIG. 6 is an exploded perspective view of the attitude maintenance mechanism.

The attitude maintenance mechanism 100 illustrated in FIGS. 2 and 3 operates according to the rocking of the boom 30 to maintain an attitude of the bucket 50 (working tool). A pair of the left and right attitude maintenance mechanisms 100 is provided. Since the left and right attitude maintenance mechanisms 100 have substantially the same configuration, the configuration of the attitude maintenance mechanism 100 will be described by taking the attitude maintenance mechanism 100 on the right side as an example, and the description of the configuration of the attitude maintenance mechanism 100 on the left side will be omitted. As illustrated in FIGS. 5 and 6, the attitude maintenance mechanism 100 includes a fixing member 101, a first link member 102, a first rocking shaft 103, the second link member 104, a second rocking shaft 105, a first coupling shaft 106, and a second coupling shaft 107.

Figure 8:
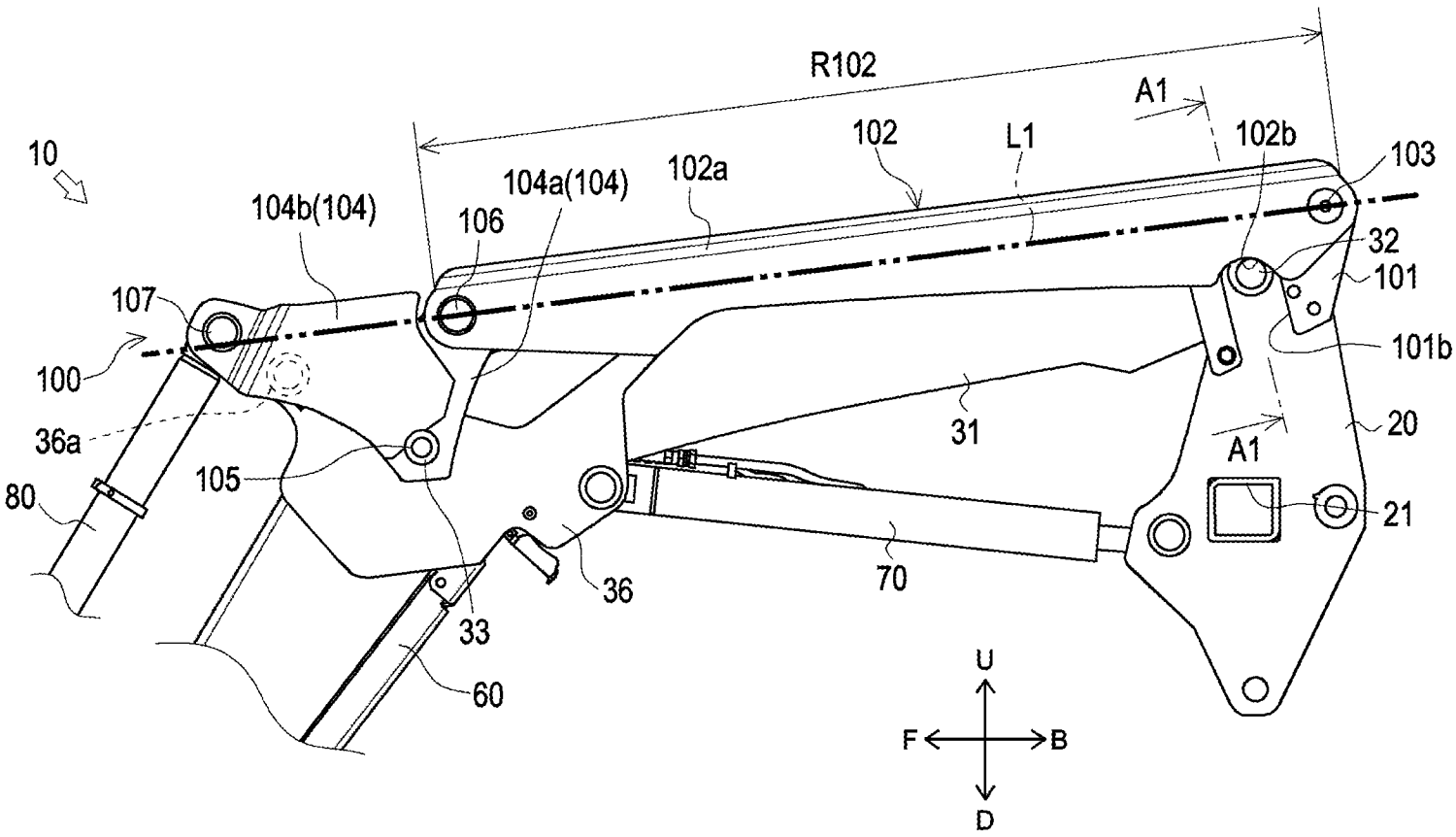
FIG. 8 is an enlarged left side view illustrating the attitude maintenance mechanism.

The fixing member 101 illustrated in FIGS. 5, 6, and 8 is a member fixed to the upper portion of the side frame 20. The fixing member 101 is formed in a plate shape with a plate surface facing substantially the left-right direction. A pair of the left and right fixing members 101 is provided. Furthermore, the fixing members 101 are formed bilaterally symmetrically with respect to each other. The left and right fixing members 101 are connected to each other by a substantially cylindrical boss portion 101*a* whose axes are oriented to the left and right. The left and right fixing members 101 are fixed to the side surfaces of the side frame 20. The fixing member 101 includes a recess 101*b*.

Figure 9:
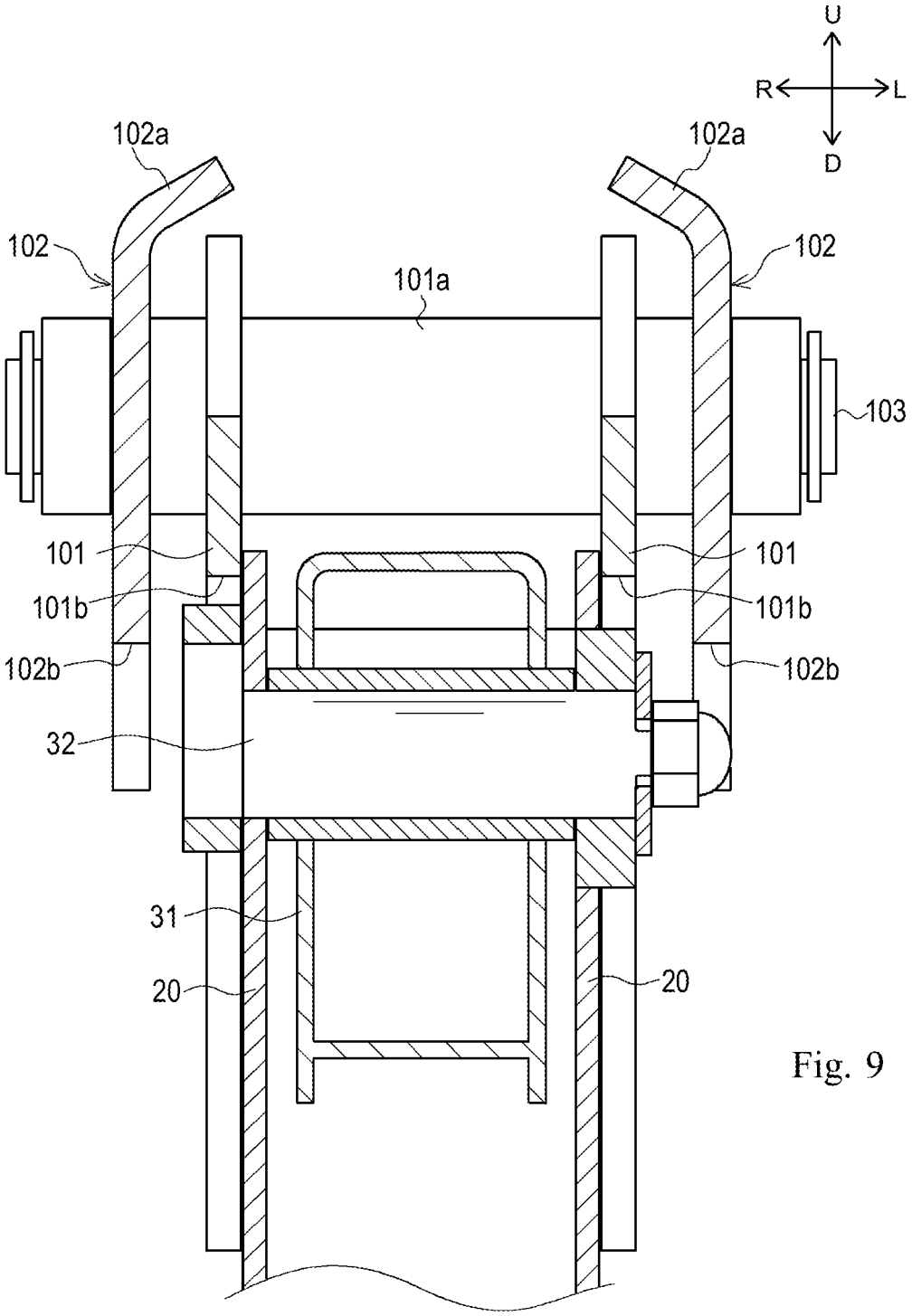
FIG. 9 is a cross-sectional view taken along line A1-A1.

The recess 101*b* illustrated in FIGS. 6, 8, and 9 is for avoiding interference with the rocking shaft 32. The recess 101*b* is formed in a substantially inverted U shape in a side view. The recess 101*b* is formed to extend from a lower end portion to an upper portion of the fixing member 101.

The first link member 102 is a member provided between the fixing member 101 and the second link member 104 described later. The first link member 102 is formed in a plate shape with a plate surface facing substantially the left-right direction. Furthermore, the first link member 102 is formed to extend substantially in the front-rear direction. A pair of the left and right first link members 102 is provided. Furthermore, the first link members 102 are formed bilaterally symmetrically with respect to each other. The first link member 102 includes a bent portion 102*a* and a recess 102*b*.

The bent portion 102*a* is a portion formed by bending the plate surface of the first link member 102. The bent portion 102*a* is formed at an upper end portion of the first link member 102. The bent portion 102*a* of the present embodiment is formed by bending the plate surfaces of the left and right first link members 102 to be close to each other (to the inside of each other). Furthermore, the bent portion 102*a* is formed to extend from the rear end portion to the front end portion of the first link member 102 (see a range R102 of the bent portion 102*a* illustrated in FIG. 8).

The recess 102*b* is for avoiding interference with the rocking shaft 32. The recess 102*b* is formed in an upwardly convex concave shape. The recess 102*b* is formed at the rear lower end portion of the first link member 102.

Figure 7A:
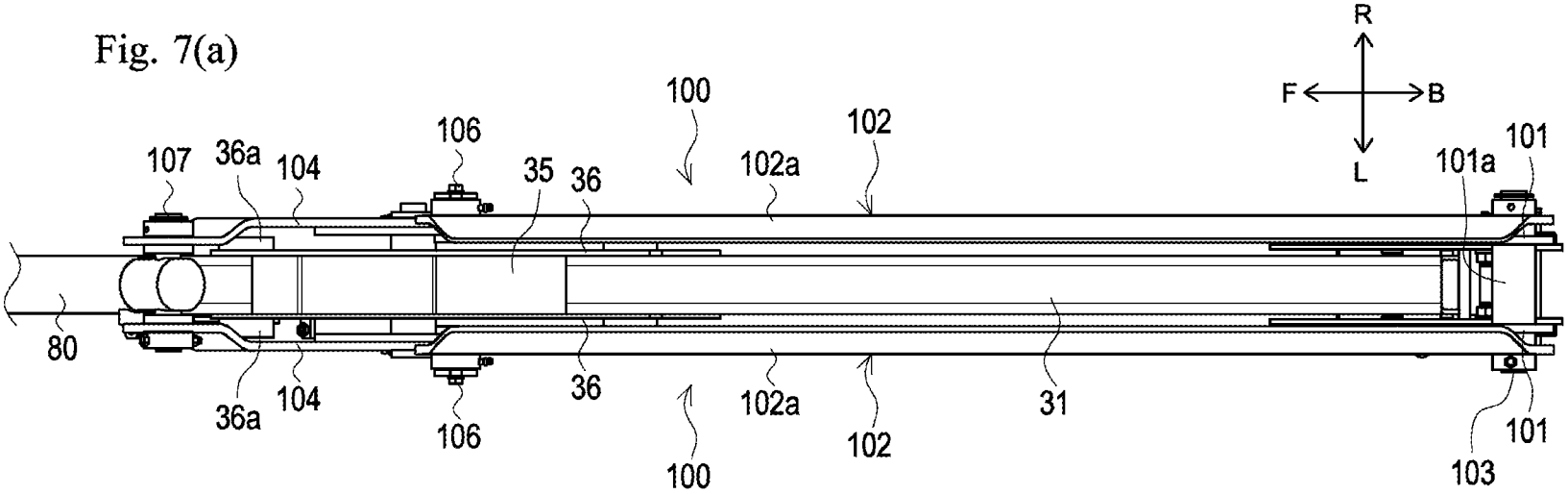
FIG. 7(*a*) is a plan view illustrating the boom, the boom cylinder, and the attitude maintenance mechanism.
Figure 7B:
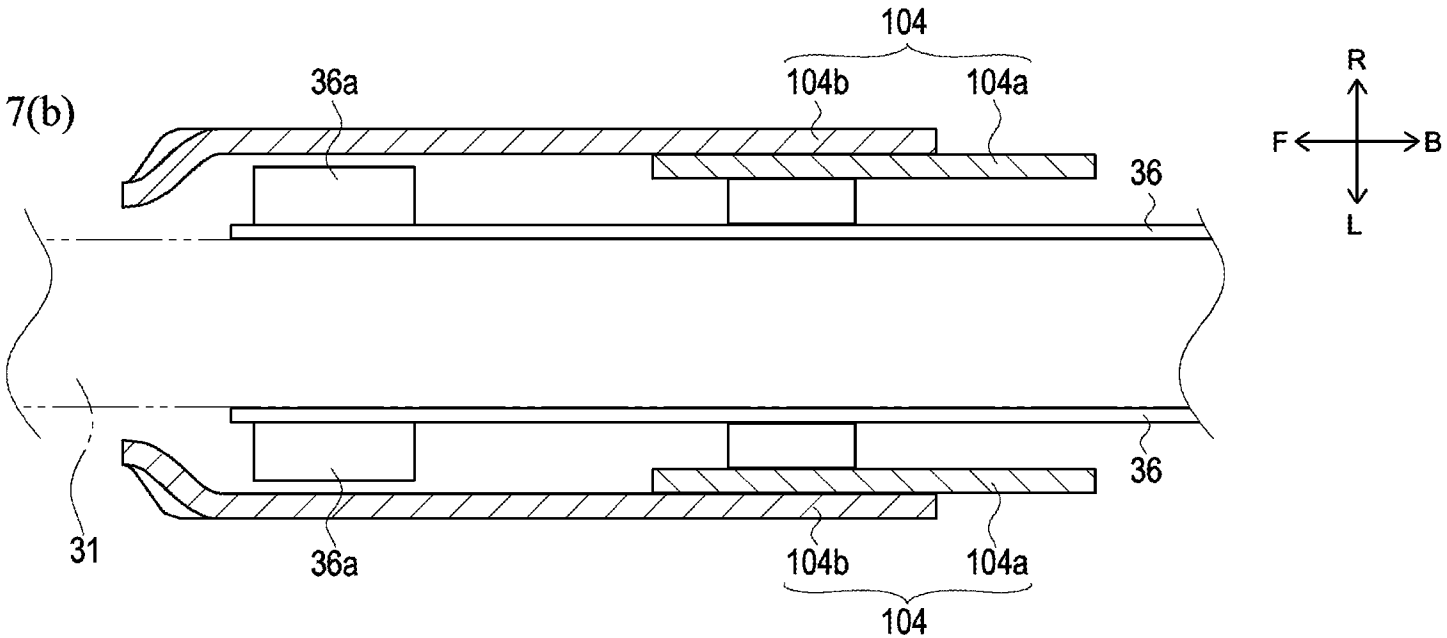

The first link member 102 configured as described above is disposed on the left and right sides of the boom frame 31 and the fixing member 101. In this way, a pair of the left and right first link members 102 is provided with the boom frame 31 interposed therebetween. The left and right first link members 102 overlap the boom frame 31 and the fixing member 101 in a side view (see FIG. 3). Furthermore, as illustrated in FIG. 7(*a*), the left and right first link members 102 do not overlap the boom frame 31 in a plan view.

The first rocking shaft 103 illustrated in FIGS. 6, 8, and 9 is for rockably supporting the first link member 102 with respect to the side frame 20. The first rocking shaft 103 is formed in a substantially cylindrical shape with its axis oriented to the left and right. The first rocking shaft 103 is inserted into the rear end portions of the left and right first link members 102 and the boss portion 101*a* of the fixing member 101. The first rocking shaft 103 is disposed behind and above the rocking shaft 32.

The second link member 104 is a member coupled to the bucket cylinder 80 and the first link member 102. The second link member 104 is formed in a plate shape with a plate surface facing substantially the left-right direction. The second link member 104 is formed in a substantially triangular shape in a side view. A pair of the left and right second link members 104 is provided. Furthermore, the second link members 104 are formed bilaterally symmetrically with each other. As illustrated in FIGS. 6 and 8, the second link member 104 includes a first member 104*a* and a second member 104*b*.

The first member 104*a* is a member forming a rear portion of the second link member 104. The first member 104*a* is formed in a substantially plate shape. The second member 104*b* is a member forming a front portion of the second link member 104. The second member 104*b* is formed in a substantially plate shape. The second member 104*b* is fixed to one of the left and right sides of the first member 104*a*. Thus, the second member 104*b* is formed integrally with the first member 104*a*.

As illustrated in FIGS. 6 and 7, the second link member 104 configured as described above is disposed on the left and right sides of the boom frame 31 and the side plate 36. In this way, the pair of left and right second link members 104 is provided with the boom frame 31 interposed therebetween. The left and right second link members 104 overlap the boom frame 31 and the side plate 36 in a side view (see FIG. 3). Furthermore, as illustrated in FIG. 7(*a*), the left and right second link members 104 do not overlap the boom frame 31 in a plan view.

Furthermore, as illustrated in FIG. 7(*b*), the second members 104*b* are disposed on the left and right outer sides of the first member 104*a* in a case where the boom frame 31 is used as a reference. Therefore, a gap between the second member 104*b* and the side plate 36 is larger than a gap between the first member 104*a* and the side plate 36. In the present embodiment, the second member 104*b* prevents interference with the boss portion 36*a* of the side plate 36 (see FIGS. 7(*b*) and 8).

The second rocking shaft 105 illustrated in FIGS. 4, 6, and 8 is for rockably supporting the second link member 104 with respect to the boom 30. The second rocking shaft 105 is formed in a substantially cylindrical shape with its axis oriented to the left and right. The second rocking shaft 105 is inserted into the lower end portions of the right and left second link members 104 and the boss portion 33 of the boom 30, and is supported by the boss portion 33. Thus, the second rocking shaft 105 is disposed at a relatively low height position (so as to cross the internal space S30 of the boom 30). Accordingly, since the second link member 104 can be supported at a relatively low position, it is possible to prevent the second link member 104 from blocking the field of view of the operator.

The first coupling shaft 106 illustrated in FIGS. 6 and 8 is for coupling the first link member 102 and the second link member 104. The first coupling shaft 106 is formed in a substantially cylindrical shape with its axis oriented to the left and right. In the present embodiment, as the first coupling shaft 106, a shaft-shaped member longer than a left-right width of the first link member 102 is used. The first coupling shaft 106 is fixed to the rear upper end portion of the second link member 104 and is coupled to the front end portion of the first link member 102.

The second coupling shaft 107 is for coupling the second link member 104 and the bucket cylinder 80. The second coupling shaft 107 is formed in a substantially cylindrical shape with its axis oriented to the left and right. In the present embodiment, a bolt through which the left and right second link members 104 can be inserted are used as the second coupling shaft 107. The second coupling shaft 107 couples the front upper end portion of the second link member 104 and the bucket cylinder 80 without being inserted into the boss portion 36*a* of the side plate 36.

As illustrated in FIG. 8, the second coupling shaft 107 is disposed in the vicinity of a straight line L1 passing through the first rocking shaft 103 and the first coupling shaft 106 in a side view. Furthermore, the first coupling shaft 106, the first rocking shaft 103, and the second coupling shaft 107 are disposed side by side in a direction inclined forward and downward. With the bucket 50 thus grounded, the first rocking shaft 103, the first coupling shaft 106, and the second coupling shaft 107 are disposed substantially in the same straight line, so that the coupling portion (second coupling shaft 107) between the second link member 104 and the bucket cylinder 80 can be disposed at a relatively low position.

Figure 11:
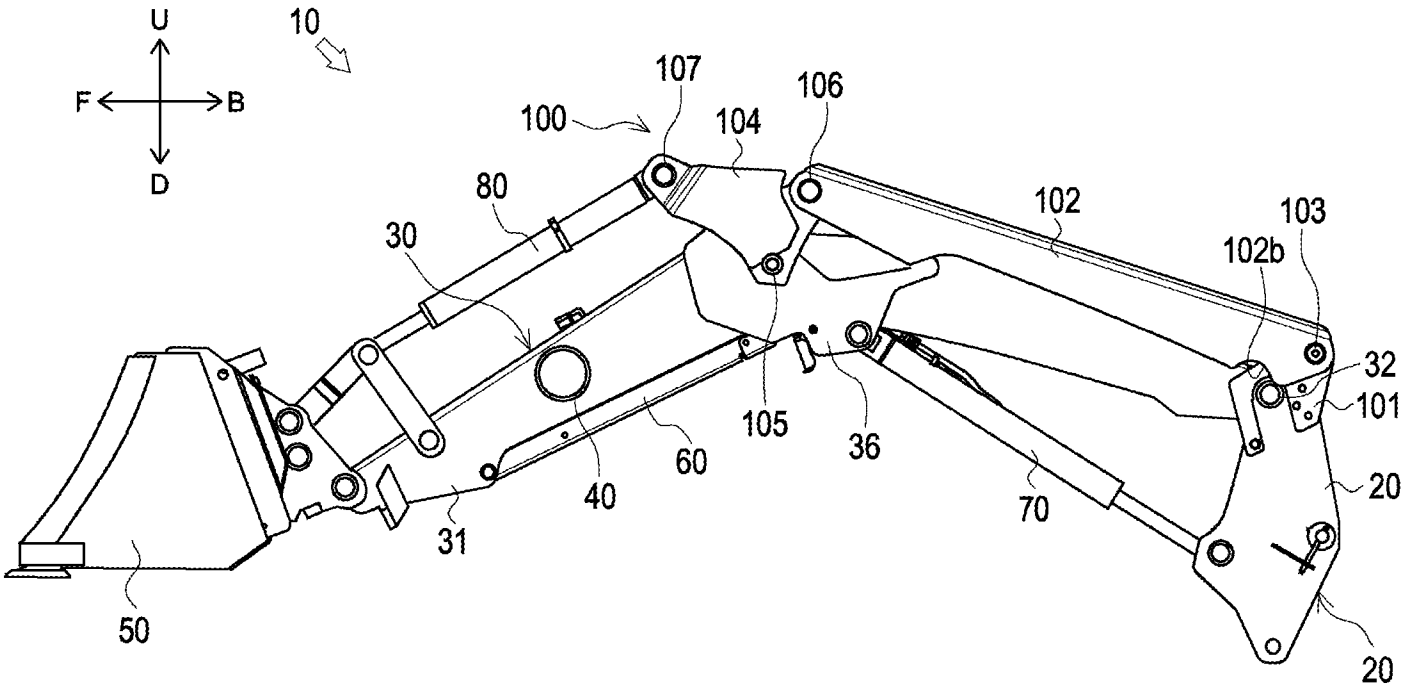
FIG. 11 is a left side view illustrating a state in which the boom is raised.
Figure 12:
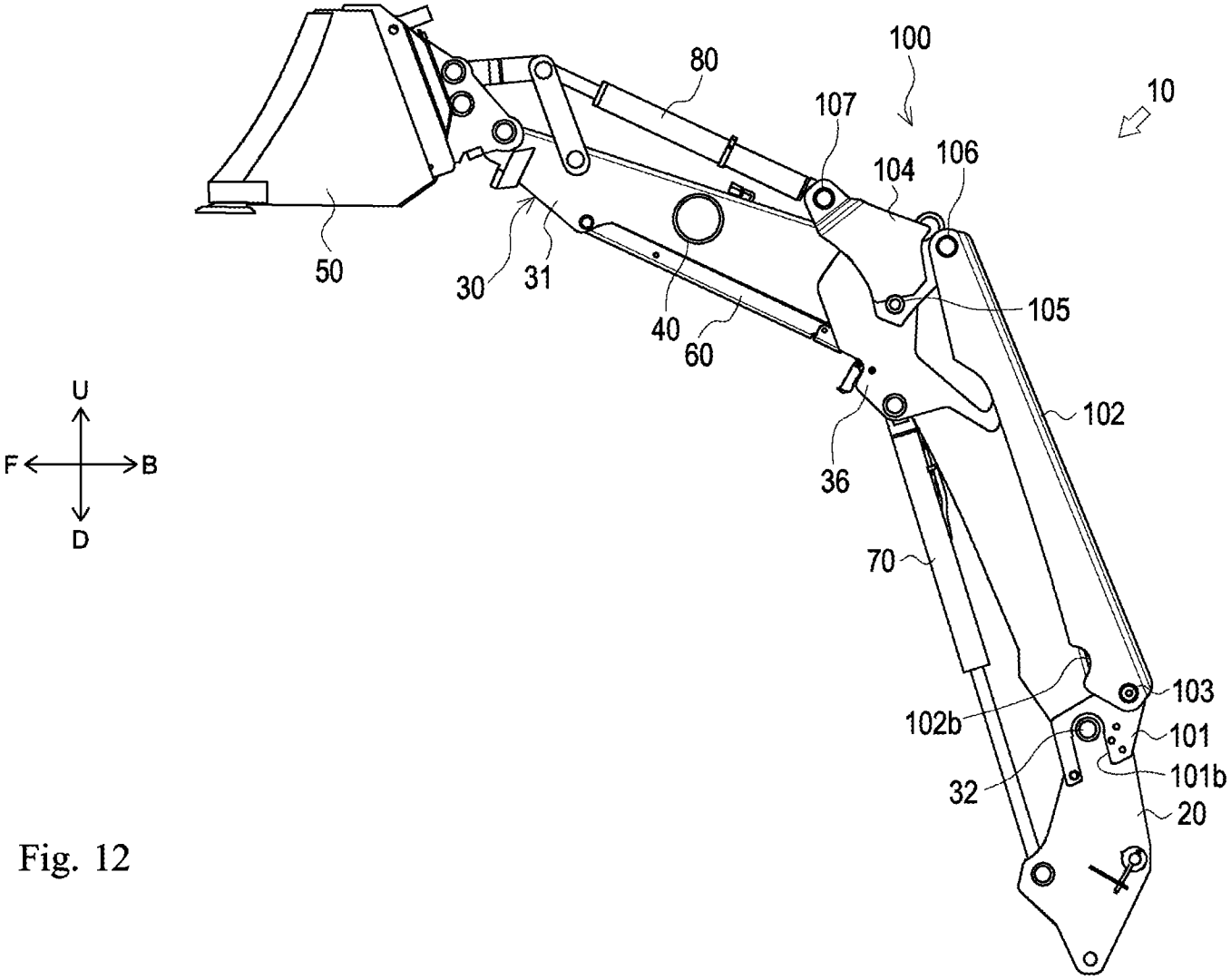
FIG. 12 is a left side view illustrating a state in which the boom is raised to the maximum.

As illustrated in FIGS. 3, 11, and 12, the boom 30 of the front loader 10 configured as described above is rocked with respect to the side frame 20 according to expansion and contraction of the boom cylinder 70. Thus, the boom 30 is raised and lowered. The first link member 102 and the second link member 104 are rocked as the boom 30 moves up and down. The attitude maintenance mechanism 100 can maintain an attitude of the bucket 50 by rocking of the link members 102 and 104 without allowing the operator to expand and contract the bucket cylinder 80.

In the attitude maintenance mechanism 100 of the present embodiment, the first link member 102 and the second link member 104 are disposed on the left and right sides with the boom frame 31 interposed therebetween. With such a configuration, the first link member 102 and the second link member 104 hardly interfere with the boom frame 31, and the degree of freedom in designing the attitude maintenance mechanism 100 can be improved. As a result, for example, a height position of the first link member 102 and the like can be lowered to such an extent that the first link member 102 and the like overlap the boom frame 31 in a side view. As a result, it is possible to suppress the first link member 102 and the like from blocking the field of view of the operator and to improve the visibility. Furthermore, by improving the visibility, the work by the front loader 10 can be easily performed, and the workability can also be improved.

In particular, the first link member 102 and the second link member 104 of the present embodiment are disposed so as not to overlap the boom frame 31 in a plan view. As a result, no matter how much the height position of the first link member 102 or the like is lowered, it does not interfere with the boom frame 31, so that the degree of freedom in design can be effectively improved.

Furthermore, the first link member 102 and the second link member 104 overlap the boom 30 with substantially no gap in a side view regardless of a rock angle of the boom 30. More specifically, the first link member 102 and the second link member 104 overlap the boom 30 without a gap in a side view regardless of the rock angle of the boom 30 except for the recess 102*b*. With such a configuration, it is possible to suppress the first link member 102 and the second link member 104 from protruding from the boom 30 and to effectively improve the visibility. Furthermore, it is possible to prevent the appearance of the attitude maintenance mechanism 100 from deteriorating and to improve the aesthetic appearance.

Furthermore, as illustrated in FIG. 4, the tube portion 90 is disposed inside the side frame 20 and the boom 30. As a result, it is possible to prevent the tube portion 90 and the attitude maintenance mechanism 100 from interfering with each other, and it is possible to prevent the tube portion 90 from being damaged due to the interference between the attitude maintenance mechanism 100 and the tube portion 90. Furthermore, the tube portion 90 can be hidden by the side frame 20 or the like to improve the aesthetic appearance. Furthermore, even if the tube portion 90 is damaged by any chance, it is possible to prevent the hydraulic oil from scattering in a wide range.

Here, the boom 30 is provided with the boss portion 33 that crosses the internal space S30. Therefore, when the tube portion 90 is assembled, if the tube portion 90 is fed out from the third opening 31*a* toward the fourth opening 31*b*, there is a concern that the boss portion 33 becomes an obstacle and it becomes difficult to assemble the tube portion 90. Therefore, in the present embodiment, the guide portion 34 is provided so that the tube portion 90 can be guided to the upper side of the boss portion 33. The guide portion 34 can guide the tube portion 90 to the fourth opening 31*b* so as to avoid the boss portion 33 (pass above the boss portion 33). As a result, it is possible to suppress the boss portion 33 from being an obstacle when the tube portion 90 is provided, and to easily dispose the tube portion 90 in the boom 30.

Figure 13:
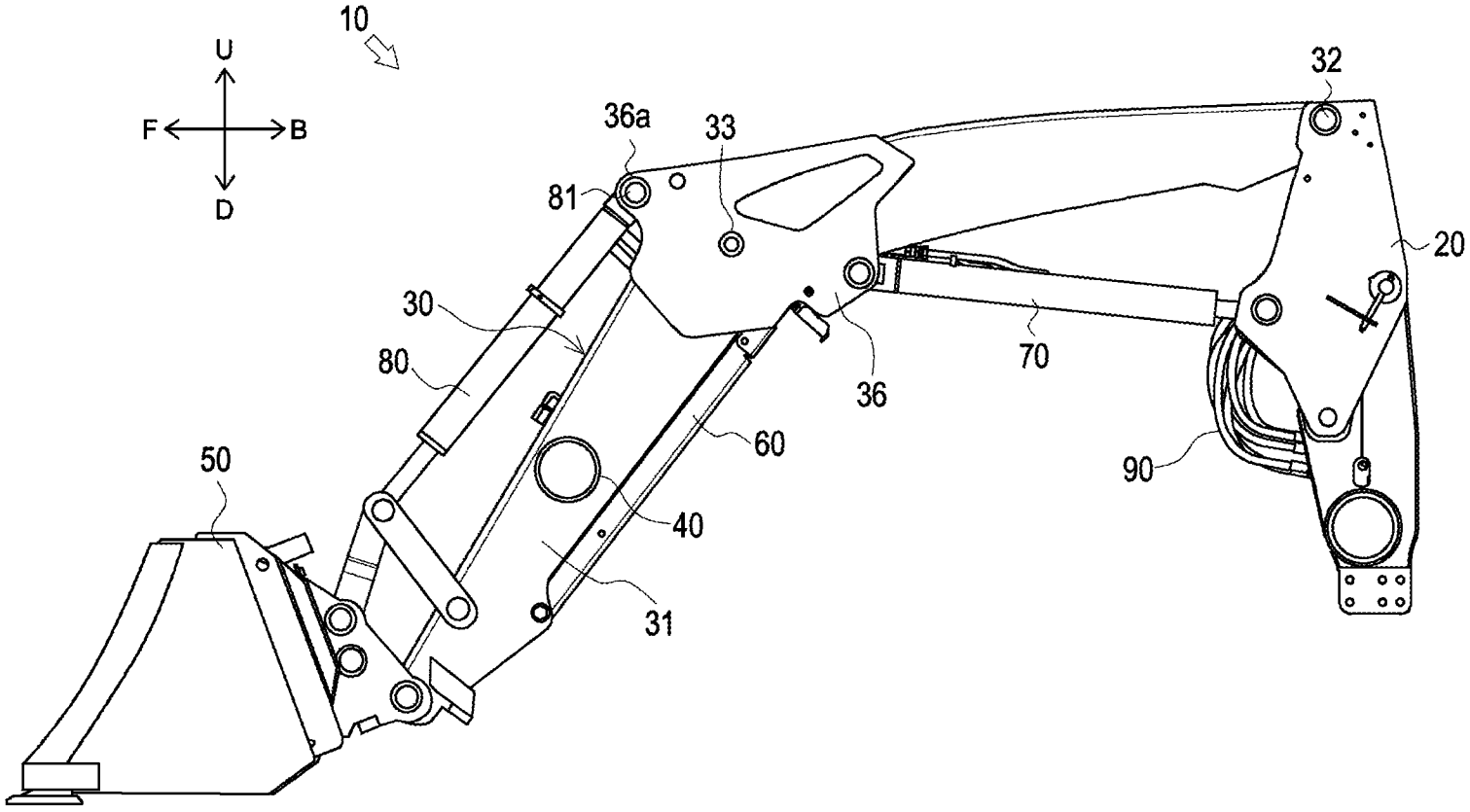
FIG. 13 is a left side view illustrating the front loader from which the attitude maintenance mechanism has been removed.

Furthermore, as described above, the bucket cylinder 80 is coupled to the second link member 104 at a relatively low position (near the straight line L1). With such a configuration, as illustrated in FIGS. 3 and 13, the common bucket cylinder 80 can be used regardless of the presence or absence of the attitude maintenance mechanism 100. As a result, the attitude maintenance mechanism 100 can be easily retrofitted.

As described above, the attitude maintenance mechanism 100 according to the present embodiment is the attitude maintenance mechanism 100 of the front loader 10 that maintains an attitude of the bucket 50 (working tool) coupled to the boom 30 by operating according to the rocking of the boom 30 including a pair of left and right boom frames 31, and includes the first link member 102 rockable with respect to the side frame 20 of the front loader 10 and the second link member 104 rockably provided with respect to the boom frames 31 and coupled to the first link member 102 and the bucket cylinder 80, in which the first link member 102 and the second link member 104 are provided as a left and right pair with each of the boom frames 31 interposed therebetween.

With such a configuration, a height position of the attitude maintenance mechanism 100 can be lowered, and the visibility can be improved by suppressing the attitude maintenance mechanism 100 from blocking the field of view of the operator.

Furthermore, the first link member 102 is disposed so as not to overlap the boom frame 31 in a plan view (see FIG. 7).

With such a configuration, the degree of freedom in design can be improved.

Furthermore, the first link member 102 and the second link member 104 are disposed such that at least a part thereof overlaps the boom 30 in a side view regardless of a rock angle of the boom 30 (See FIGS. 3, 11, and 12).

With such a configuration, visibility can be effectively improved. Furthermore, it is possible to suppress deterioration in appearance and to improve aesthetics.

Furthermore, the pair of left and right first link members 102 includes bent portions 102*a* bent inward from each other (see FIG. 9). With such a configuration, the strength of the first link member 102 can be improved by the bent portions 102*a*.

Furthermore, the bent portion 102*a* is formed to extend from a rocking shaft (rear end portion, first rocking shaft 103) of the first link member 102 to a coupling portion (front end portion, first coupling shaft 106) between the first link member 102 and the second link member 104 (see FIG. 8).

With such a configuration, the strength of the first link member 102 can be effectively improved.

Furthermore, the second link member 104 includes a first member 104*a* and a second member 104*b* fixed to one of the left and right sides of the first member 104*a* (see FIG. 7(*b*)).

With such a configuration, one of the first member 104*a* and the second member 104*b* (the second member 104*b* in FIG. 7(*b*)) can be moved away from the boom frame 31 to secure a gap with the boom frame 31.

Furthermore, the rocking shaft (first rocking shaft 103) of the first link member 102, the coupling portion (first coupling shaft 106) between the first link member 102 and the second link member 104, and the coupling portion (second coupling shaft 107) between the second link member 104 and the bucket cylinder 80 are located on substantially the same straight line in a side view (see FIG. 8).

With this configuration, the height position of the coupling portion (second coupling shaft 107) between the second link member 104 and the bucket cylinder 80 can be lowered.

Furthermore, the pair of left and right first link members 102 are formed to be bilaterally symmetrical with each other, and the pair of left and right second link members 104 are formed to be bilaterally symmetrical with each other.

With such a configuration, a sense of unity can be provided to the pair of left and right first link members 102 and the pair of left and right second link members 104, and the aesthetic appearance can be improved. Furthermore, the first link member 102 and the second link member 104 can be attached to both the left and right side frames 20 and the left and right boom frames 31 (can also serve as components). Furthermore, the balance of strength between the left link members 102 and 104 and the right link members 102 and 104 is improved, and it is possible to prevent the occurrence of defects (deformation of the link members 102 and 104 and the like).

Furthermore, the front loader 10 according to the present embodiment includes the attitude maintenance mechanism 100.

With such a configuration, a height position of the attitude maintenance mechanism 100 can be lowered, and the visibility can be improved by suppressing the attitude maintenance mechanism 100 from blocking the field of view of the operator.

Furthermore, the rocking shaft (second rocking shaft 105) of the second link member 104 is provided so as to cross the internal space S30 of the boom 30 (see FIG. 4).

With such a configuration, the rocking shaft (second rocking shaft 105) of the second link member 104 can be disposed at a relatively low position, and it is possible to suppress the second link member 104 from blocking the field of view of the operator.

Furthermore, the boom 30 and the tube portion 90 disposed inside the boom 30 are provided, and the boom 30 includes the boss portion 33 (support portion) that supports the rocking shaft (second rocking shaft 105) of the second link member 104, and the guide portion 34 at least a part of which is disposed inside the boom 30 and that guides the tube portion 90 so as to avoid the boss portion 33.

With such a configuration, the tube portion 90 can be easily disposed in the boom 30.

Note that the bucket 50 according to the present embodiment is an embodiment of a working tool according to the present invention.

Furthermore, the boss portion 33 according to the present embodiment is an embodiment of a support portion according to the present invention.

Although the embodiment of the present invention has been described above, the present invention is not limited to the above configurations, and various modifications can be made within the scope of the invention described in the claims.

For example, the first link member 102 includes the bent portion 102*a* and the recess 102*b*, but the configuration of the first link member 102 is not limited thereto, and can be arbitrarily changed.

Furthermore, although the first link member 102 does not overlap the boom frame 31 in a plan view, a positional relationship between the first link member 102 and the boom frame 31 in a plan view is not particularly limited. For example, a part of the first link member 102 may overlap the boom frame 31 in a plan view.

Furthermore, although the second link member 104 includes the first member 104*a* and the second member 104*b*, the configuration of the second link member 104 is not limited thereto, and can be arbitrarily changed. For example, the second link member 104 may be formed of one plate-like member. Furthermore, the second link member 104 may be formed so as to avoid interference with the boss portion 36*a* by appropriately bending the plate surface.

Furthermore, although the first link member 102 and the second link member 104 overlap the boom 30 in a side view, a positional relationship between the first link member 102 and the like and the boom frame 31 in a side view is not particularly limited. For example, of the first link member 102 and the second link member 104, only the second link member 104 may overlap the boom 30 in a side view.

Furthermore, the first rocking shaft 103, the first coupling shaft 106, and the second coupling shaft 107 are located on substantially the same straight line in a side view, but a positional relationship among the first rocking shaft 103, the first coupling shaft 106, and the second coupling shaft 107 can be arbitrarily changed.

Furthermore, although the first link members 102 are formed to be bilaterally symmetrical, the present invention is not limited thereto, and for example, the first link members may be formed to be bilaterally asymmetrical.

Furthermore, the second link members 104 are formed to be bilaterally symmetrical, but is not limited thereto, and may be formed to be bilaterally asymmetrical, for example.

Furthermore, although both left and right end portions of the boss portion 33 protrude from the boom 30, this is an example, and at least a part thereof may be disposed in the boom 30.

Furthermore, although the substantially entire guide portion 34 is disposed in the boom 30, this is merely an example, and at least a part thereof may be disposed in the boom 30.

Furthermore, although the tube portion 90 is provided so as to pass above the boss portion 33, this is an example, and a portion where the tube portion 90 passes through the boss portion 33 is not particularly limited. For example, the tube portion 90 may be provided so as to pass below the boss portion 33. In this case, the guide portion 34 is appropriately provided so as to guide the tube portion 90 below the boss portion 33.

Furthermore, although at least a part of the tube portion 90 is disposed in the side frame 20 and the boom 30, this is an example, and the arrangement of the tube portion 90 is not particularly limited.

INDUSTRIAL APPLICABILITY

The present invention can be used for a technique of an attitude maintenance mechanism of a front loader and the front loader that maintains an attitude of a working tool coupled to a boom.

REFERENCE SIGNS LIST

10: Front loader
20: Side frame
30: Boom

31: Boom frame
50: Bucket
80: Bucket cylinder
100: Attitude maintenance mechanism
102: First link member
103: Second link member

The invention claimed is:

1. An attitude maintenance mechanism of a front loader that maintains an attitude of a working tool coupled to a boom by operating according to rocking of the boom including a pair of left and right boom frames, the attitude maintenance mechanism comprising:

a fixing member mounted to each of the boom frames, the fixing member having a recess to accommodate a shaft connecting each of the boom frames to a side frame such that the fixing member does not interfere with the shaft, the recess of the fixing member being a cut out of a lower end of the fixing member;

a first link member that is rockable with respect to the side frame of the front loader, a rear lower end portion of the first link member extending below the shaft, the rear lower end portion of the first link member including a recess to accommodate the shaft such that the first link member does not interfere with the shaft, the recess of the first link member being a cutout of the rear lower end portion of the first link member; and a second link member rockably provided with respect to the boom frames and coupled to the first link member and a bucket cylinder, wherein the first link member and the second link member are provided as a left and right pair with each of the boom frames interposed between the first link member and the second link member.

2. The attitude maintenance mechanism of a front loader according to claim 1, wherein the first link member is disposed so as not to overlap with the boom frames in a plan view.

3. The attitude maintenance mechanism of a front loader according to claim 2, wherein the first link member and the second link member are disposed such that at least a part of the first link member and the second link member overlap the boom in a side view regardless of a rock angle of the boom.

4. The attitude maintenance mechanism of a front loader according to claim 3, wherein a pair of the left and right first link members includes bent portions bent inward from each other.

5. The attitude maintenance mechanism of a front loader according to claim 4, wherein each of the bent portions is formed to extend from a rocking shaft of each of the first link members to a coupling portion between the first link member and the second link member.

6. The attitude maintenance mechanism of a front loader according to claim 2, wherein a pair of the left and right first link members includes bent portions bent inward from each other.

7. The attitude maintenance mechanism of a front loader according to claim 6, wherein each of the bent portions is formed to extend from a rocking shaft of each of the first link members to a coupling portion between the first link member and the second link member.

8. The attitude maintenance mechanism of a front loader according to claim 2, wherein the second link member includes:

a first member; and a second member fixed to one of left and right sides of the first member.

9. The attitude maintenance mechanism of a front loader according to claim 1, wherein the first link member and the second link member are disposed such that at least a part of the first link member and the second link member overlap the boom in a side view regardless of a rock angle of the boom.

10. The attitude maintenance mechanism of a front loader according to claim 9, wherein a pair of the left and right first link members includes bent portions bent inward from each other.

11. The attitude maintenance mechanism of a front loader according to claim 10, wherein each of the bent portions is formed to extend from a rocking shaft of each of the first link members to a coupling portion between the first link member and the second link member.

12. The attitude maintenance mechanism of a front loader according to claim 9, wherein the second link member includes:

a first member; and a second member fixed to one of left and right sides of the first member.

13. The attitude maintenance mechanism of a front loader according to claim 1, wherein a pair of the left and right first link members includes bent portions bent inward from each other.

14. The attitude maintenance mechanism of a front loader according to claim 13, wherein each of the bent portions is formed to extend from a rocking shaft of each of the first link members to a coupling portion between the first link member and the second link member.

15. The attitude maintenance mechanism of a front loader according to claim 1, wherein the second link member includes:

a first member; and a second member fixed to one of left and right sides of the first member.

16. The attitude maintenance mechanism of a front loader according to claim 1, wherein a rocking shaft of the first link member, a coupling portion between the first link member and the second link member, and a coupling portion between the second link member and the bucket cylinder are located on substantially a same straight line in a side view.

17. The attitude maintenance mechanism of a front loader according to claim 1, wherein a pair of the left and right first link members is formed to be bilaterally symmetrical with each other, and a pair of the left and right second link members is formed to be bilaterally symmetrical with each other.

18. A front loader comprising the attitude maintenance mechanism according to claim 1.

19. The front loader according to claim 18, wherein a rocking shaft of the second link member is provided so as to cross an internal space of the boom.

20. The front loader according to claim 19, further comprising:

the boom; and a tube portion disposed inside the boom, wherein the boom includes:

a support portion that supports the rocking shaft of the second link member; and a guide portion at least a part of which is disposed inside the boom and that guides the tube portion so as to avoid the support portion.

* * * * *